United States Patent [19]

Behar

[11] 4,267,869

[45] May 19, 1981

[54] HANDY BAG

[76] Inventor: Marvin L. Behar, 316 Main St., Edmonds, Wash. 98020

[21] Appl. No.: 88,164

[22] Filed: Oct. 25, 1979

[51] Int. Cl.[3] ..... A45C 3/00

[52] U.S. Cl. ..... 150/50; 150/51

[58] Field of Search ..... 150/50, 51, 49, 48

[56] References Cited

U.S. PATENT DOCUMENTS

| | | | |
|---|---|---|---|
| 1,155,475 | 10/1915 | Fay | 150/49 |
| 1,865,645 | 7/1932 | Schroder | 150/48 |
| 3,173,464 | 3/1965 | Curtis | 150/50 X |
| 3,306,329 | 2/1967 | Braun | 150/50 |
| 4,193,625 | 3/1980 | Nelson | 294/19 A |

*Primary Examiner*—Donald F. Norton

*Attorney, Agent, or Firm*—Thomas W. Secrest

[57] ABSTRACT

This invention is for a handy bag which can be made from readily available materials. The readily available materials can be metal and plastic such as plumbing fixtures. Normally, the handy bag comprises a base and a handle means. The base and the handle means can be made from plastic plumbing parts and glued or bonded together. Then, there can be a closure means which can be prepared from cloth or plastic. The closure means is fastened to the base and also to the handle means. The handy bag can be used for the storage of articles such as clothes and also for the transportation of articles such as clothes to and from a washing unit and drying unit such as a commercial laundromat.

5 Claims, 4 Drawing Figures

HANDY BAG

A BRIEF SUMMARY OF THE INVENTION

This invention is for a handy bag for carrying articles.

The invention comprises a base, a handle means and a bag. The base and handle means are integral. The bag operatively connects with the base and the handle means.

It is possible to carry items such as clothes, to be washed, or clothes which have been washed in this handy bag.

The source for the materials for making this invention are, readily, commercially available. The source of materials for the base and the handle means can be plastic plumbing parts. The bag can be of cloth or plastic.

THE DRAWINGS

Figure 3:
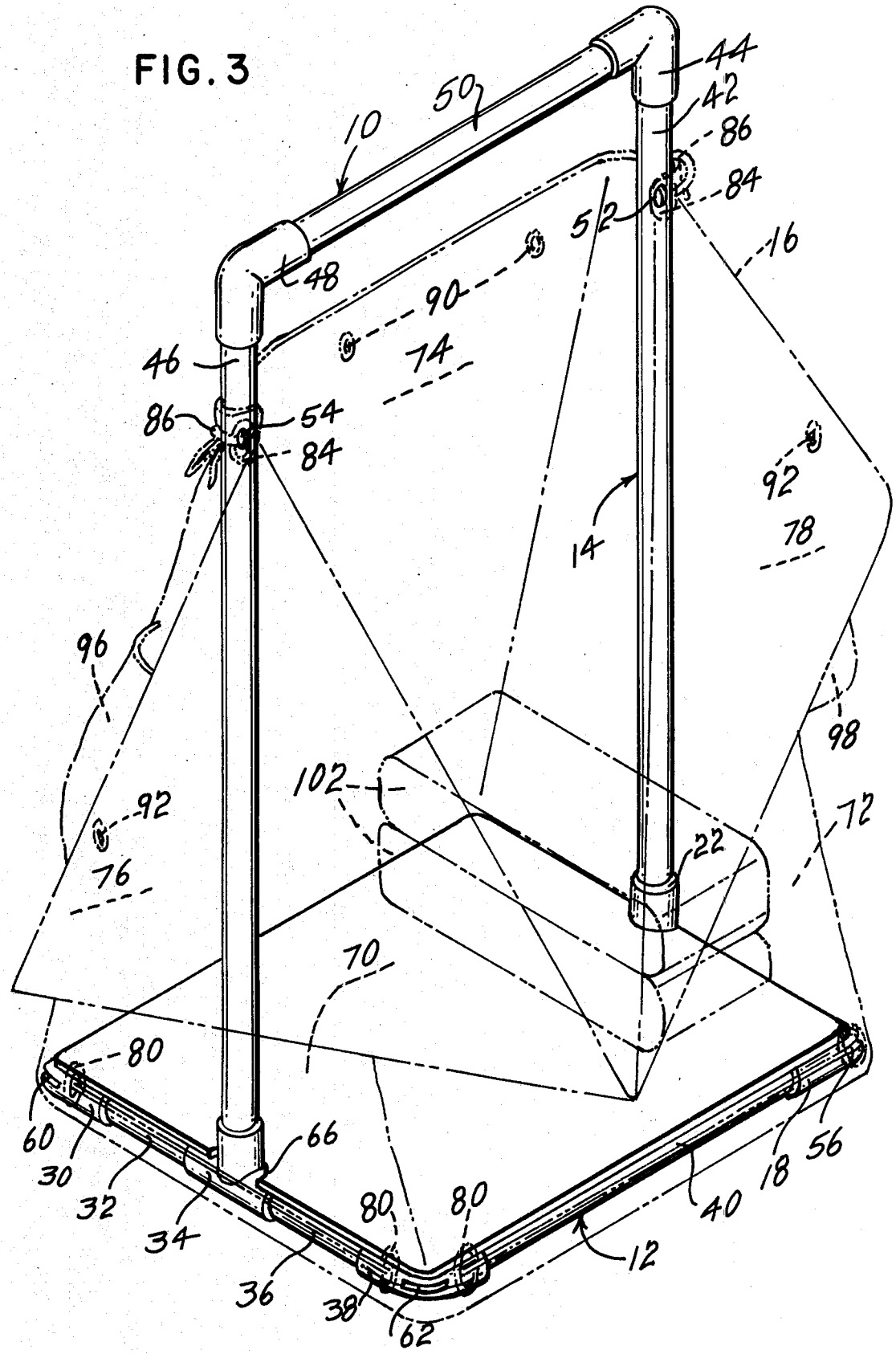
Figure 4:
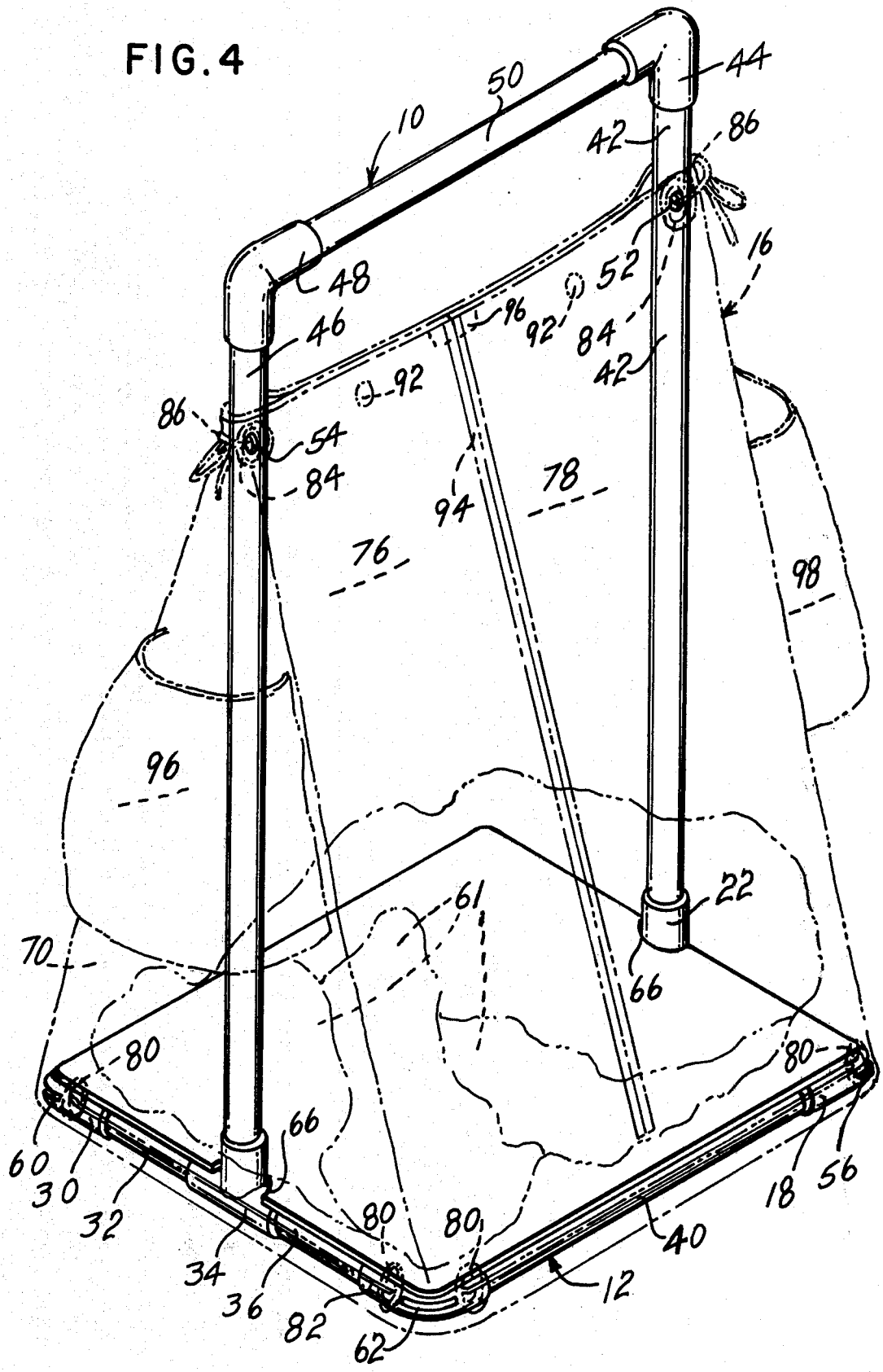

FIG. 3 is an isometric view of the integral base and handle means, the bag operatively connecting with the base and the handle means, the bag being opened and disclosing folded clothes resting on the base, with the bag and the folded clothes in phantom; and, FIG. 4 is an isometric view illustrating the integral base and handle means, the bag, in phantom, and clothes to be washed resting on the base and inside the bag with the clothes being in phantom.

THE SPECIFIC DESCRIPTION OF THE INVENTION

Figure 2:
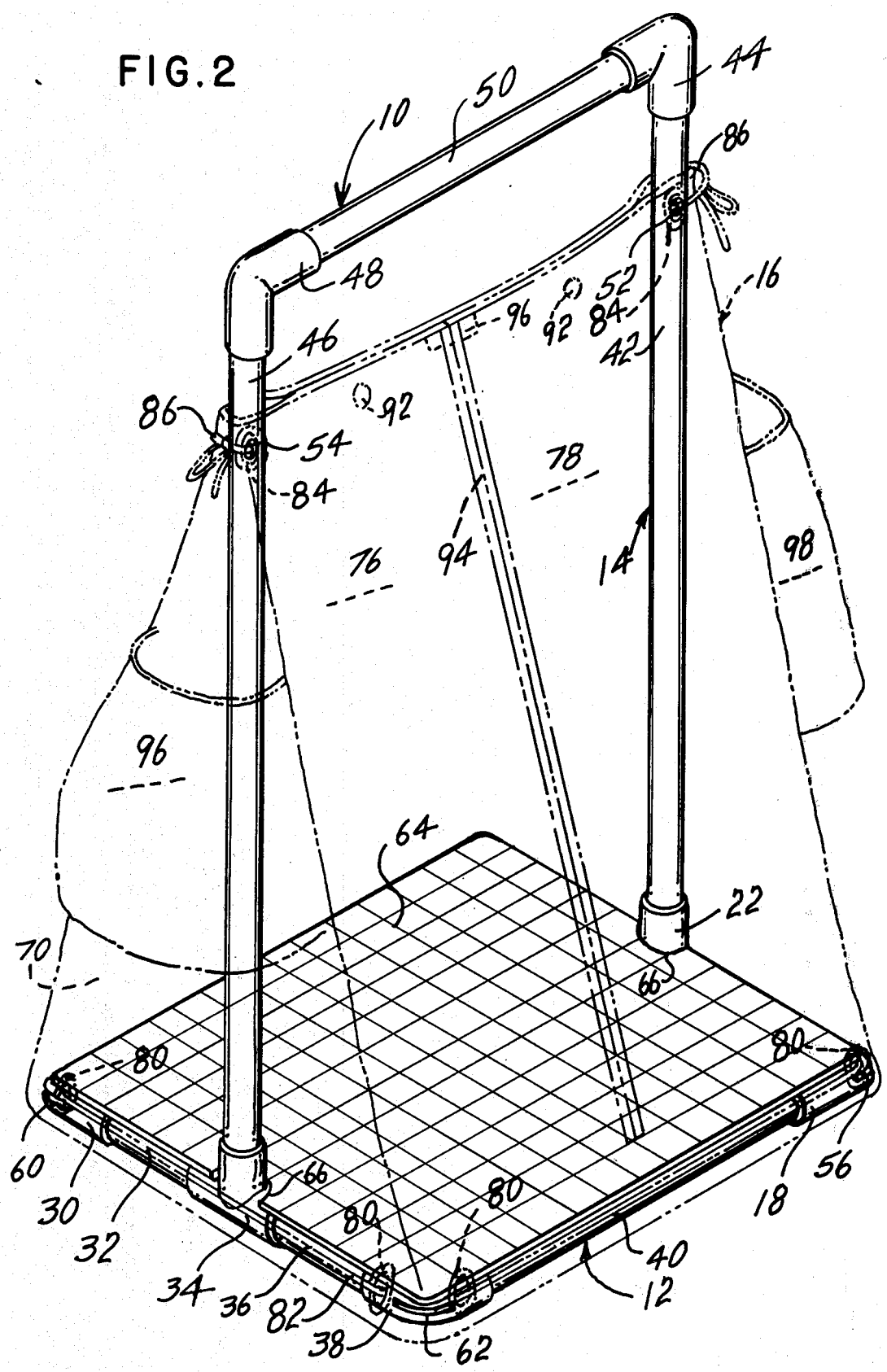
FIG. 2 is an isometric view of a handy bag and illustrates the base, a handle means and the bag, operatively connecting with the base and the handle.

In the drawings, see FIGS. 2, 3 and 4, there is illustrated a handy bag 10 comprising a base 12, a handle means 14 and a closure means 16.

Figure 1:
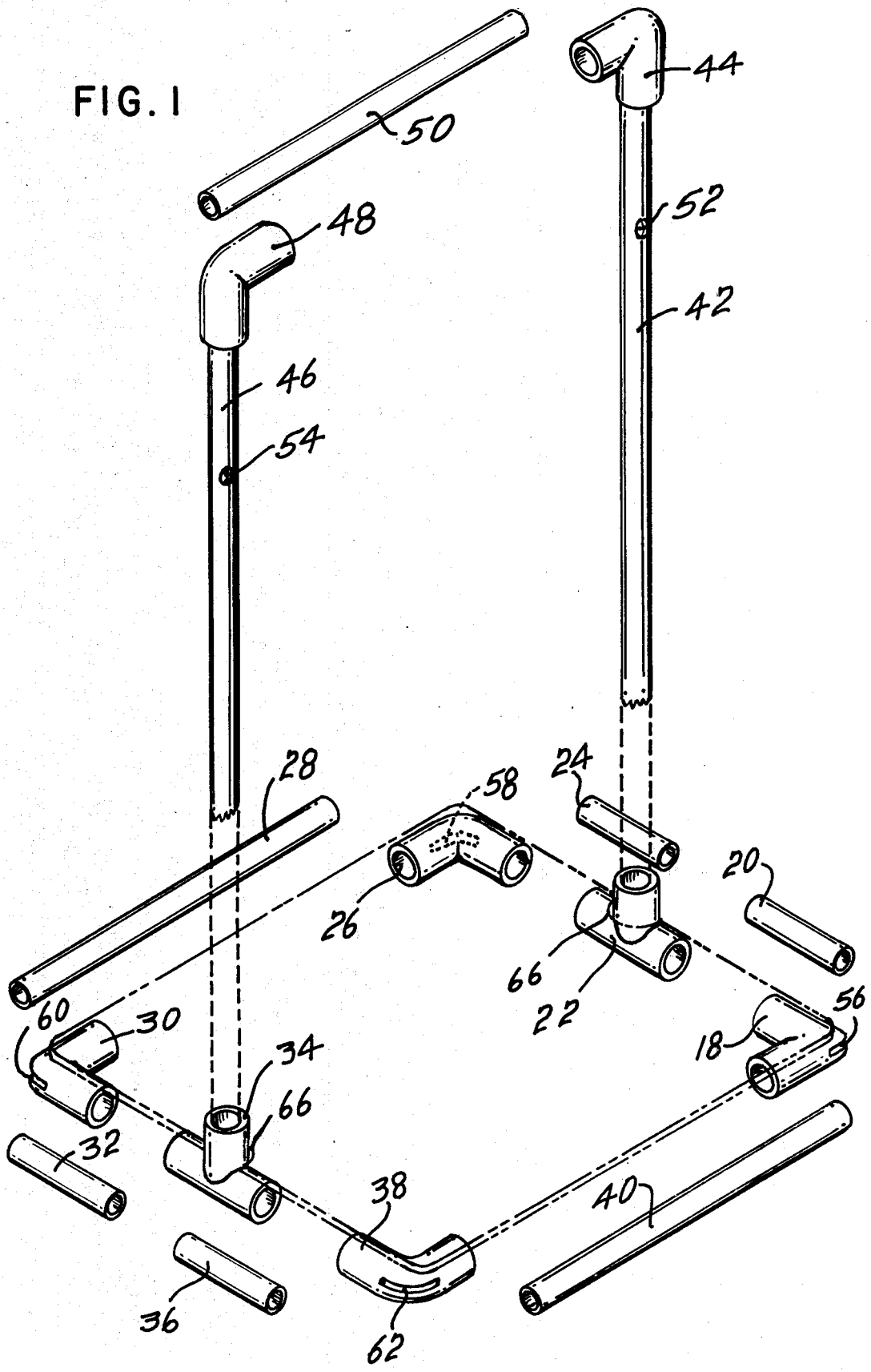
FIG. 1 is an exploded view of the base and the handle means.

In FIG. 1 there is illustrated an exploded view of the base 12 and the handle means 14. It is seen that the base 12 comprises a first elbow or connecting means 118 and a first connecting member or first short tube 20. There is a first tee 22. the first short tube 20 connects with the first elbow 18 and the first tee 22.

There is a second connecting member or second short tube 24 and a connecting means or second elbow 26. The second short tube 24 connects with the first tee 22 and the second elbow 26. There is a third connecting member or first long pipe 28 and a third connecting means or third elbow 30. The third connecting member 28 connects with the second elbow 26 and the third elbow 30.

There is a fourth connecting member or third short tube 32 and a second tee 34. The third short tube 32 connects with the third elbow 30 and the second tee 34.

There is a fourth short tube or fifth connecting member 36 and a fourth elbow or fourth connecting means 38. The fourth short tube 36 connects with the second tee 34 and the fourth elbow 38.

There is a sixth connecting member or a second long pipe 40 which connects with the fourth elbow 38 and the first elbow 18.

The handle means 14 comprises a first upright leg 42 and a fifth connecting means or fifth elbow 44. The first upright leg 42 connects with the first tee 22 and the fifth elbow 44.

There is a second upright leg 46 and a sixth connecting means or a sixth elbow 48. The second upright leg 46 connects with the second tee 34 and the sixth elbow 48.

There is a seventh connecting member or a third long pipe 50 which connects with the fifth elbow 44 and the sixth elbow 48.

In the first upright leg 42 and near the fifth elbow 44 there is a first passageway 52. In the second upright leg 46 and near the sixth elbow 48 there is a second passageway 54.

On the outside corner of the first elbow 18 there is a groove 56. On the outside corner of the second elbow 26 there is a groove 58. On the outside corner of the third elbow 30 there is a groove 60. On the outside corner of the fourth elbow 38 there is a groove 62.

The connecting members 20, 24, 28, 32, 36, 40 and 50 can be solid or tubular.

I have found that desirable material in construction for the base and the handle means is plastic plumbing fixtures known as "ABS" plumbing fixtures. These plumbing fixtures are commercially available and, relevantly, inexpensive. The connecting members and elbows and tees can be joined into an integral unit by applying acetone to the members and then forcing the members together. The acetone softens the plastic plumbing members. The plumbing members can be joined, when softened, and the acetone will dry so as to cement or adhere together the various members into an integral unit.

There is a bottom support 64 which may be plywood, pressed board, fiberboard or a screen, to name a few. In the drawings it is seen that the bottom support 64 is slightly larger than the inside dimensions of the base and slightly smaller than the outside dimensions of the base. The bottom support 64 is of a generally square or rectangular configuration. Near the tees 22 and 34 the bottom support 64 is recessed at 66. The bottom support rests on the upper surfaces of the base members and, in particular, on the upper surfaces of the elbows 18, 26, 30 and 38. The connecting members are, generally, of a smaller outside diameter than the outside diameter of the elbows so the bottom support 64 rests on the upper surfaces of the elbows.

The closure means 16 may be cloth or a sheet of plastic. Generally, the closure means will be a sheet material such as cloth or plastic and have a wide open bottom which tapers upwardly so as to be capable of being closed at the top. In FIGS. 2, 3 and 4 there is illustrated a closure means 16 having a first side 70, a second side 72, a back side 74 and a front comprising a first panel 76 and a second panel 78.

Again, the bottom of the closure means 16 is open. The sides or side panels 70 and 72 are of a generally triangular configuration and are on the outside of the upright legs 42 and 46. The back panel is of a generally rectangular or square configuration and slopes inwardly from the outside of the base towards the upper part of the legs 42 and 46.

The front panel comprises the panels 76 and 78 and these two panels are of a generally rectangular or square configuration and slope upwardly and inwardly from the outside of the base toward the upper part of the legs 42 and 46.

In the lower part of the sides 70 and 72 in the back panel 74 and the front panels 76 and 78 there are a number of eyelets 80. The eyelets 80 are, generally, of metal. A strand of cloth or wire or plastic may be passed through the eyelets 80 so as to be on the outside of the sides 72, 74 in the area of the tees 22 and 24 and the short pipes 20, 24, 32 and 36. Also, the strand 82 is on the outside of the panels 74, 76 and 78 in the area of the long pipes 28 and 40. In the area of the elbows 18, 26, 30 and 38 the strand 82 is on the inside of the sides 70, 72 and the panels 74, 76 and 78 and is positioned in the grooves 56, 58, 60 and 62. In this manner the closure means 16, the lower end of the closure means 16, is positioned with respect to the base 12.

On the upper part of the flaps 76 and the side 70 and the back panel 74 there are eyelets 84. A strand or string or twine 86 can be passed through the eyelets 84 and through the second passageway 54 in the upper part of the upright leg 46 so as to attach the upper part of the closure means 16 to the leg 46 and handle means 18.

Likewise, on the upper part of the flap 78 and the side panel 72 and the back panel 74 there are eyelets 84. Again, a string or strand or twine can be passed through the eyelets 88 and the passageway 52 and the first upright leg 42 so as to attach the upper part of the closure means 16 to the upright leg 42 and the handle means 14.

On the upper part of the back panel 74 there are first parts 90 of a snap. On the upper part of the flap 76 and the flap 78 are second parts 92 of a snap. The parts 90 and 92 can be snapped together so as to close the upper part of the closure means 16.

The first panel 76 and the second panel 78 can be joined by means of a closure 94. The closure 94 may be a zipper having a hand clasp 96 for zipping together the panels 76 and 78 or allowing the panels 76 and 78 to separate. In FIG. 2 there is illustrated the panels 76 and 78 as being zipped together or united.

In FIG. 3 the panels 76 and 78 are illustrated as being separated and apart.

There can be attached to the side 70 a first pocket 96. The sides and the lower part of the pocket 96 are attached to the sides 70. The upper part of the pocket 96 is open.

On the side 72 there may be a second pocket 98. The side and bottom of the pocket 98 are attached to the side 72. The upper part of the pocket 98 is open.

The handy bag 10 can be used for carrying miscellaneous items. For example, the handy bag 10 can be used for carrying groceries, papers and clothes. I consider one of the best uses for this bag 10 is to carry clothes to and from the washing facilities or laundry facilities such as a commercial laundromat. In FIG. 4 there is illustrated dirty clothes 61 in the handy bag 10. These dirty clothes can be carried to the laundromat, washed, dried and folded so as to be placed in the bag 10. In FIG. 3 there is illustrated clothes 102 which have been folded and stacked in the bag 10 so as to be on the bottom support 64. In FIG. 3 it is seen that the flaps 76 and 78 have been separated for ease of placing the folded clothes, such as towels, sheets, pillow cases and the like in the bag 10. After the clothes have been folded and placed in the bag 10 the flaps 76 and 78 can be joined as illustrated in FIGS. 2 and 4.

This bag 10 is light in weight. For example, the bag 10 can be prepared from readily available material such as plastic plumbing fixtures which, in themselves, are light in weight. The plastic plumbing fixtures can be tubular so as to not have a great deal of weight per volume. The closure means 16 can be prepared from cloth or sheet plastic and it in inself is light in weight. The bag 10 has a handle means such as the member 50 for ease of grabbing and holding onto the bag thereby making it easy to carry the bag 10. Further, because of the structure of the bag, there is a large volume carrying capacity. The carrying capacity may be sufficient for one or two normal washer loads of dirty clothes. Also, the dirty clothes can be readily placed into the bag by separating the flaps 76 and 78 and putting the clothes in the bag. Likewise, the clothes can be easily removed from the bag by separating the flaps 76 and 78 of the closure means so as to reach in and take out the clothes. In addition, the bag can be used for the storing of dirty clothes until the dirty clothes can be washed and cleaned and dried. In fact, with two or more handy bags 10 it is possible, by color coding or other means to have one of the bags for dirty white clothes and one of the bags for dirty colored clothes. In this manner the clothes have already been sorted according to which clothes will be washed. The clothes can be sorted as to color and stored until there are a sufficient number of clothes for one or two normal loads in a washing machine. From the foregoing and having presented my invention,

What I claim is:

1. An article carrying device comprising a base and a closure means:

A. a base comprising:

1. a first tee, a second tee, a first short tube, a second short tube, a third short tube, a fourth short tube, a first long pipe, a second long pipe, a first connecting means, a second connecting means, a third connecting means and a fourth connecting means;
2. said first short tube connecting with said first connecting means and said first tee;
3. said second short tube connecting with said first tee and said second connecting means;
4. said first long pipe connecting with said second connecting means and said third connecting means;
5. said third short tube connecting with said third connecting means and said second tee;
6. said fourth short tube connecting with said second tee and said fourth connecting means;
7. said second long pipe connecting with said fourth connecting means and said first connecting means;

B. a handle means comprising:

8. a first upright leg connecting with said first tee and a fifth connecting means;
9. a second upright leg connecting with said second tee and a sixth connecting means;
10. a third long pipe connecting with said fifth connecting means and said sixth connecting means;

C. said closure means comprising:

11. a bottom support operatively connecting with said base for supporting articles;
12. a bag, operatively, connecting with said base to support said articles and to assist in positioning said articles on said base;

D. said bottom support having exterior dimensions larger than the interior dimensions of said base so as to rest upon and to be supported by members of said base; and, E. said bottom support being a solid sheet.

2. An article carrying device comprising a base and a closure means:

A. a base comprising:

1. a first tee, a second tee, a first short tube, a second short tube, a third short tube, a fourth short tube, a first long pipe, a second long pipe, a first connecting means, a second connecting means, a third connecting means and a fourth connecting means;
2. said first short tube connecting with said first connecting means and said first tee;
3. said second short tube connecting with said first tee and said second connecting means;
4. said first long pipe connecting with said second connecting means and said third connecting means;
5. said third short tube connecting with said third connecting means and said second tee;
6. said fourth short tube connecting with said second tee and said fourth connecting means;
7. said second long pipe connecting with said fourth connecting means and said first connecting means;

B. a handle means comprising:

8. a first upright leg connecting with said first tee and a fifth connecting means;
9. a second upright leg connecting with said second tee and a sixth connecting means;
10. a third long pipe connecting with said fifth connecting means and said sixth connecting means;

C. said closure means comprising:

11. a bottom support operatively connecting with said base for supporting articles; and,
12. a bag, operatively, connecting with said base to support said articles and to assist in positioning said articles on said base;
13. said connecting members being elbows;
14. said base and said handle means being plastic;
15. said bottom support having exterior dimensions larger than the interior dimensions of said base so as to rest upon and to be supported by members of said base;
16. said first connecting means, said second connecting means, said third connecting means and said fourth connecting means having an exterior groove for receiving and for positioning a first strand;
17. said bag having a bottom part and a top part;
18. said bottom part having means for receiving said first strand to position said bottom part with respect to said base;
19. said handle having means for receiving a second strand;
20. the top part of said bag having means to receive said strand;
21. said second strand attaching the top part of said bag to said handle means;
22. said bag having a side connecting together said bottom part and said top part;
23. said side having a division which divides said side into a first part and into a second part making it possible to move the first part and the second part to look into the interior of said part; and,
24. a means releasably uniting said first part and said second part.

3. An article carrying device comprising a base and a closure means according to claim 2 comprising:

a. said bottom support being a solid sheet.

4. An article carrying device comprising a base and a closure means according to claim 2 comprising:

a. said bottom support having notches.

5. An article carrying device comprising a base and a closure means according to claim 2 comprising:

a. said means for releasably uniting said first part and said second part being a zipper means.

* * * * *